United States Patent [19]

Hart

[11] 3,967,766

[45] July 6, 1976

[54] TIE ATTACHMENT FOR COAT HANGER

[76] Inventor: Joseph M. Hart, 5433 W. National Ave., Milwaukee, Wis. 53214

[22] Filed: Nov. 13, 1975

[21] Appl. No.: 631,763

[52] U.S. Cl. ..... 223/85; 223/91; 223/96; 211/113; 211/124

[51] Int. Cl.[2] ..... A47J 51/094

[58] Field of Search ..... 223/DIG. 1, 85, 91, 223/96, 88; 211/113, 124

[56] References Cited

UNITED STATES PATENTS

| | | | |
|---|---|---|---|
| 2,153,905 | 4/1939 | Yankovitch | 223/88 |
| 2,428,820 | 10/1947 | Therrien | 223/88 |
| 3,459,349 | 8/1969 | Batts | 223/91 |
| 3,760,995 | 9/1973 | Wheeler | 211/113 X |

*Primary Examiner*—George H. Krizmanich
*Attorney, Agent, or Firm*—Henry C. Fuller

[57] ABSTRACT

A coat hanger having a paperboard sleeve on the lower run is provided with an elastomeric band and projecting guide located centrally of the sleeve and depending downwardly therefrom and in which the elongated runs of the band are arranged around the guide and cross over beneath the sleeve to tension the elongated band runs against the sleeve to clamp ties or the like to the sleeve.

2 Claims, 4 Drawing Figures

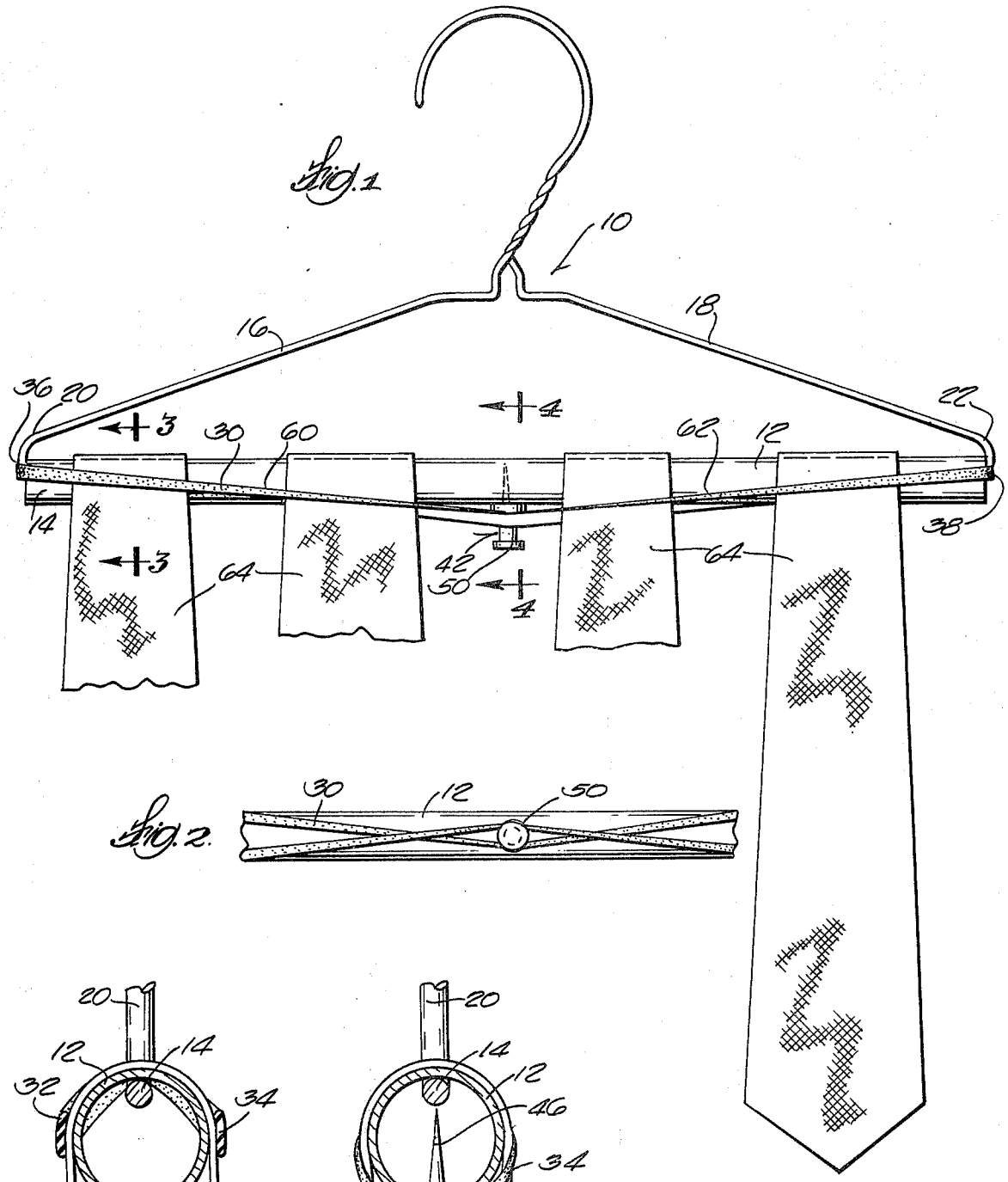
Fig. 1
Fig. 2
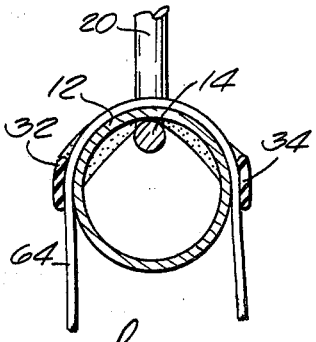
Fig. 3
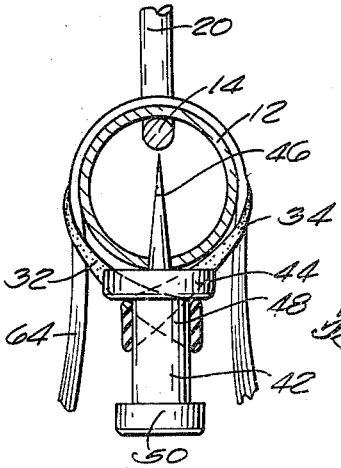
Fig. 4

TIE ATTACHMENT FOR COAT HANGER

SUMMARY OF INVENTION

The invention provides an attachment for a coat hanger to enable the coat hanger to retain securely small items such as ties for traveling salesman, etc. An elongated elastomeric band is arranged around the ends of the coat hanger and the elongated runs are trained around a centrally located guide which extends through the paperboard sleeve. The runs are criss-crossed about the guide so that the runs securely grip the paperboard sleeve and thus, press and hold the article or tie against the sleeve to securely retain it in place.

Further objects, advantages and features of the invention will become apparent from the following disclosure.

DESCRIPTION OF DRAWINGS

FIG. 1 is a side elevational view of a coat hanger with the improvement of the invention.

FIG. 2 is a fragmentary bottom view of the coat hanger shown in FIG. 1.

FIG. 3 is a view along line 3—3 of FIG. 1.

FIG. 4 is a view along line 4—4 of FIG. 1.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

In the drawings, FIG. 1 shows a conventional coat hanger 10 which is provided with a paperboard sleeve 12 which spans the lower hanger run 14. The lower run 14 merges with inwardly and upwardly converging runs 16, 18 at junctures 20, 22. In accordance with the invention, there is provided an elastomeric band 30 having elongated runs 32 and 34. The ends 36, 38 of the band 30 are arranged around the junctures 20, 22 of the hanger.

In accordance with the invention, guide means are provided intermediate the length of the sleeve 12 and fastened to the sleeve to cooperate with the elongated runs 32, 34 of the band to place the bands in tension and contact with the sleeve for securely gripping ties. In the disclosed construction, the guide means comprises a member 42 having a base 44, a pin 46, a shank 48 and a shank head 50. The member 48 is located intermediate the ends of the sleeve as shown in FIG. 1 with the point 46 projecting through the sleeve. The base 44 abuts the sleeve and provides stable support therefor. The shank 48 engages the runs 32 and 34 which are criss-crossed about the guide as shown best in FIG. 2. The criss-cross arrangement causes both stretching of the elongated runs and causes the runs to contact the sleeve at points 60, 62 along the sleeve. The band runs 32, 34 are thus under tension and securely grip a tie 64 which is draped over the sleeve to prevent the tie from readily falling from the hanger.

I claim:

1. In a hanger of the type having a lower supporting run including a paperboard sleeve spanning the run and having upwardly converging runs extending from the lower run, the improvement comprising a continuous elastomeric band having opposed ends and elongated runs with said opposed ends arranged around the juncture of said lower run and converging runs of said hanger and above said sleeve and guide means located intermediate the length of said sleeve and fastened to said sleeve and projecting downwardly therefrom and said band having its elongated runs trained about said guide means with said elongated runs crossing each other on opposite sides of said guide means whereby said elongated runs are engaged under tension with said sleeve at points intermediate the ends of said sleeve and said guide to clamp articles to said sleeve.

2. The improvement of claim 1 wherein said guide means comprises a pin with a point projecting through the wall of said sleeve and having a headed shank portion about which said elongated runs of the band are trained.

* * * * *